US005908119A

United States Patent [19]

Kump et al.

[11] Patent Number: 5,908,119

[45] **Date of Patent: *Jun. 1, 1999**

[54] POWER WING CLIP

[75] Inventors: Daniel J. Kump, Mentor; Joseph P. Kosir, Cleveland, both of Ohio

[73] Assignee: Fasteners For Retail, Inc., Cleveland, Ohio

[ * ] Notice: This patent is subject to a terminal disclaimer.

[21] Appl. No.: 08/956,245

[22] Filed: Oct. 22, 1997

Related U.S. Application Data

[63] Continuation-in-part of application No. 08/799,845, Feb. 13, 1997, abandoned, which is a continuation-in-part of application No. 08/711,670, Sep. 4, 1996, Pat. No. 5,720,398.

[51] Int. Cl.[6] ..... A47F 5/00

[52] U.S. Cl. ..... 211/113; 211/149; 211/186; 211/126.16; 248/215; 248/301; 248/231.81; 248/316.7

[58] Field of Search ..... 24/113, 149, 126.16, 24/126.6, 186; 248/51, 74.2, 215, 231.81, 231.31, 301, 316.7, 124

[56] References Cited

U.S. PATENT DOCUMENTS 1,856,847 5/1932 Gates .
2,811,326 10/1957 Ericson .
3,019,954 2/1962 Faltin .
3,248,765 5/1966 Achabal et al. .
3,297,815 1/1967 Drettmann .
3,599,918 8/1971 Patchett .
3,772,742 11/1973 Gigante .
4,982,848 1/1991 Church et al. .
5,509,632 4/1996 Mesna et al. .
5,720,398 2/1998 Kump et al. ..... 211/113

*Primary Examiner*—Robert W. Gibson, Jr.
*Attorney, Agent, or Firm*—Fay, Sharpe, Beall, Fagan, Minnich & McKee

[57] ABSTRACT

An integrally formed hanger fixture includes a substantially vertically oriented wall having a top end and a bottom end. A substantially horizontally oriented wall is connected to the top end of the vertical wall. A retainer element is disposed on the vertically oriented wall. A wing overlies the horizontally oriented wall. A hinge connects the wing to the horizontally oriented wall. The hinge enables the wing to pivot in relation to the horizontally oriented wall until the wing is disposed beneath the horizontally oriented wall. The retainer element can be a wall, a layer of adhesive, a channel or an aperture. A rear retainer wall is preferably connected to the bottom end of the vertically oriented wall and extends upwardly therefrom in a substantially parallel manner. The hanger fixture can be used in a number of different ways to fasten display racks to a variety of different types of store shelving.

28 Claims, 11 Drawing Sheets

POWER WING CLIP

BACKGROUND OF THE INVENTION

This application is a continuation-in-part of U.S. patent application Ser. No. 08/799,845 which was filed on Feb. 13, 1997 and has now been abandoned. That application, in turn, is a continuation-in-part of U.S. patent application Ser. No. 08/711,670 which was filed on Sep. 4, 1996, has now issued as U.S. Pat. No. 5,720,398 dated Feb. 24, 1998.

This invention relates to hanger fixtures for supporting display racks or containers. More particularly, the invention relates to an integrally formed hanger fixture which can be secured to a store shelf and used for holding a display rack or a container.

It is common in merchandising to use hanger fixtures or shelf extenders for presenting product literature, products or display racks of products for purchase. Some of the extenders are small plastic extruded clips having members which slidably fit into horizontally extending price channels secured onto display shelves or other supports. Lightweight goods for sale or advertisements which do not force the clip away from the price channel are then fitted by plastic connectors, hooks or other means onto the clip for display thereon.

Other shelf extenders and hanger fixtures are supported by a shelf or other supporting surface to give added stability and provide a stronger support for larger, heavier objects and display racks. It is known, for example, to use clamp extenders to retain larger and heavier objects as compared to the smaller clips prevalent in merchandising. However, the use of clamps is burdensome.

Other similar large extenders and hanger fixtures do not incorporate a clamp. However, many of these are not retained well on a shelf or have a structure mandating a complex wall design to ensure proper stability of a supported display rack or container. In addition, it is difficult to readily interconnect containers or display racks to many of the complex hanger fixtures.

Many of the known extenders and hanger fixtures extend substantially beyond the shelf to which they are affixed. Therefore, large vertically-oriented containers or display racks which are retained thereon often will swing freely relative to the hanger fixture without adequate support from the shelves or other vertical wall faces adjacent the display rack backside.

An integrally formed hanger fixture for supporting a display rack is also known. The hanger fixture is formed as an L-shaped bracket having substantially horizontal and substantially vertical walls. A retainer wall is connected to a lower portion of the vertical wall and extends upwardly therefrom in substantially parallel spaced relation to the vertical wall to define a gap between the vertical wall and the retainer wall. The retainer wall slides into a slot formed on a rear wall of the display rack. A pressure sensitive adhesive is positioned on the underside of the horizontal wall of the bracket for adhesively securing the hanger fixture to a support surface such as a display rack.

However, even this known hanger fixture is disadvantageous from a number of standpoints. First, the hanger, since it includes a layer of adhesive, is meant to be permanently secured to a store shelf. Second, the hanger fixture is generally not fastened to a vertically-oriented wall of the display shelf unless a secondary strip of adhesive is provided on the underside of the vertical wall of the bracket. Therefore, the hanger fixture can be detached from the vertical wall upon the removal of articles held in the display rack supported by the hanger fixture, or even by jostling of the display rack as a patron of the store brushes past the display rack. Third, no means is provided for positively locking the hanger fixture to the store shelf, when so desired, and unlocking the hanger fixture from the store shelf for ready detachability. Fourth, the known hanger fixture cannot be secured to wire shelving. Fifth, the known hanger fixture needs to have a retainer wall to enable it to hold a display rack and the display rack needs a slot to cooperate with the hanger fixture.

Accordingly, it has been considered desirable to develop a new and improved hanger fixture for holding display racks on store shelves which would overcome the foregoing difficulties and others while providing better and more advantageous overall results.

BRIEF SUMMARY OF THE INVENTION

In accordance with the present invention, a new and improved integrally formed hanger fixture is provided.

More particularly, the hanger fixture comprises a first wall and a second wall which is connected to the first wall and angles away from it. A retainer element is located on the first wall. A wing overlies the second wall. A hinge connects the wing to the second wall wherein the hinge enables the wing to pivot in relation to the second wall until the wing is disposed beneath the second wall.

Preferably, a layer of a friction material is located on the wing. The hanger fixture can further include a third wall connected to the first wall and extending in a spaced, substantially parallel manner in relation thereto. The third wall preferably comprises a top extension which is located below the second wall. If desired, a layer of a friction material can be located on at least a part of one face of the top extension. The retainer means can comprise an aperture, a channel, a retainer wall or an adhesive layer. Preferably, the hanger fixture is formed from a resilient material.

In accordance with another aspect of the invention, there is provided a hanger fixture for supporting a display rack.

More particularly, the hanger fixture comprises a substantially vertically oriented wall having a first end and a second end. A substantially horizontally oriented wall is connected to the substantially vertically oriented wall adjacent the first end thereof and a retainer means is located on the substantially vertically oriented wall for selectively retaining an associated display rack. A wing is spaced from the substantially horizontally oriented wall. A hinge connects the wing to the substantially horizontally oriented wall wherein the hinge enables the wing to pivot in relation to the substantially horizontally oriented wall.

One advantage of the present invention is the provision of a new and improved hanger fixture for supporting display racks.

Another advantage of the present invention is the provision of a hanger fixture which includes a wing that is pivotally mounted thereon. The wing is employed for selectively locking the hanger fixture to a store shelf.

Still another advantage of the present invention is a hanger fixture which is formed in a unitary manner from one or more types of thin resilient material so as to be inexpensive and easy to use.

Yet another advantage of the present invention is the provision of an L-shaped hanger fixture which can have both a horizontal wall and a vertical wall thereof selectively locked to and unlocked from a store shelf.

Still yet another advantage of the present invention is the provision of a hanger fixture which will tightly hold onto a store shelf to prevent dislodgement of the fixture and of a display rack mounted on the fixture, without the need for a layer of adhesive.

An additional advantage of the present invention is the provision of a hanger fixture which can be used either on store shelving or on racks or baskets made of spaced metal rods or the like to support display racks therefrom.

A further advantage of the present invention is the provision of a hanger fixture which has a substantially vertically extending wall on which are provided retainer means for cooperating with a display rack. The retainer means can comprise a forwardly extending arm, an aperture, a channel or an adhesive layer.

A still further advantage of the present invention is the provision of a hanger fixture which includes a pair of spaced substantially vertically extending walls and a pair of spaced substantially horizontally extending surfaces connected to the vertically extending walls.

A yet further advantage of the present invention is the provision of a hanger fixture which includes layers of friction material on opposing surfaces of the fixture to prevent a sliding of the hanger fixture along a store shelf when the hanger fixture is secured to the store shelf.

Still other benefits and advantages of the invention will become apparent to those skilled in the art upon reading and understanding of the following detailed specification.

BRIEF DESCRIPTION OF THE DRAWINGS

The invention may take physical form in certain parts and arrangements of parts preferred embodiments of which will be described in detail in this specification and illustrated in the accompanying drawings which form a part hereof and wherein.

DETAILED DESCRIPTION OF THE PREFERRED EMBODIMENTS

Figure 1:
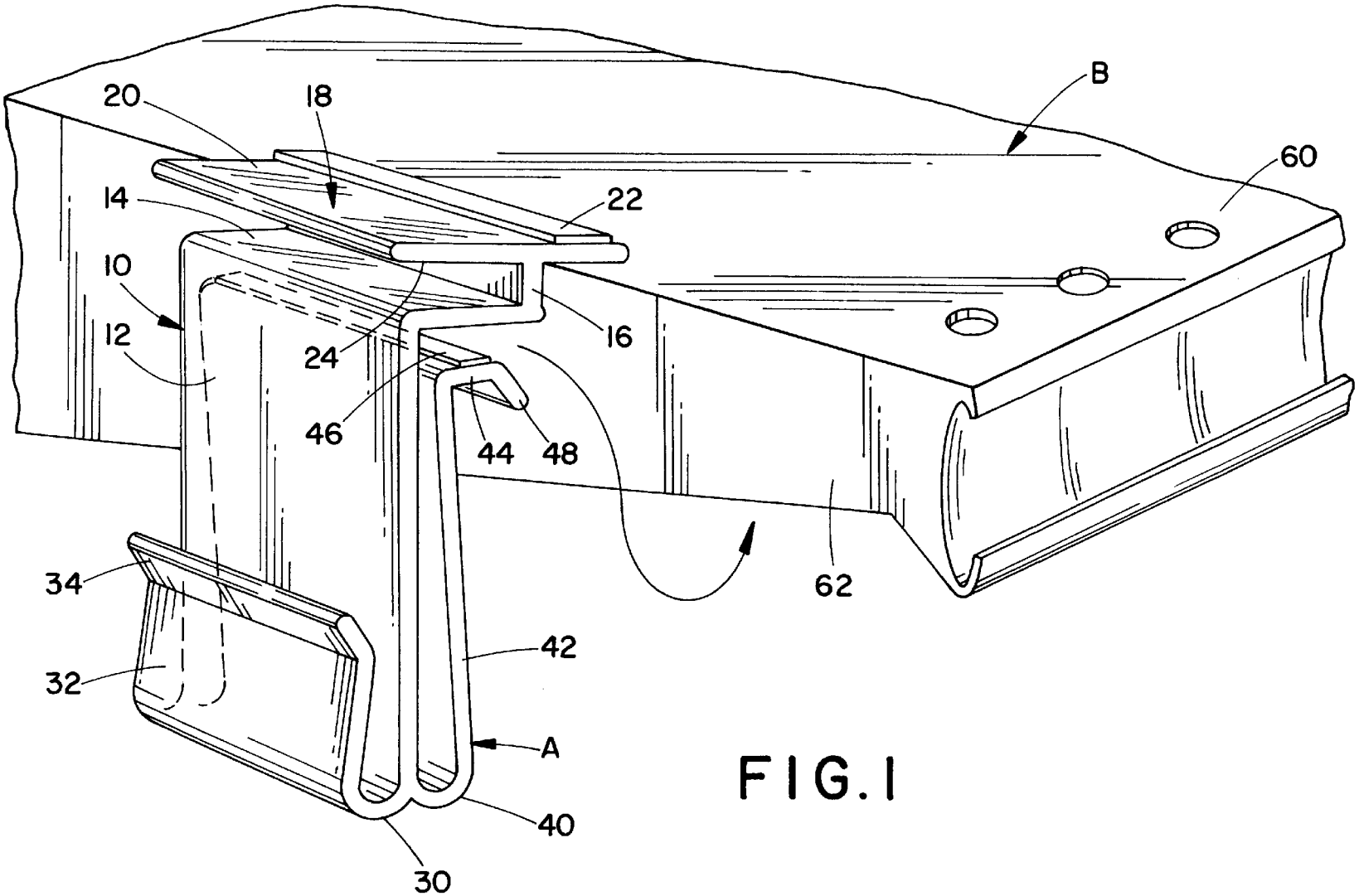
FIG. 1 is an exploded perspective view of a hanger fixture according to a first preferred embodiment of the present invention before it is secured to a store shelf.

Referring now to the drawings, wherein the showings are for purposes of illustrating preferred embodiments of the invention only and not for purposes limiting same, FIG. 1 shows a hanger fixture A which can be selectively secured to a conventional store shelf B according to a first preferred embodiment of the present invention.

The hanger fixture comprises a hanger body 10 having a vertical wall 12 and, extending at approximately a right angle therefrom, a horizontal or top wall 14. Disposed at a free end of the top wall is a hinge 16 made from a resilient material. The hinge connects the top wall to a wing 18 which extends parallel to the top wall when the hinge is not in use. The wing has a first face 20 on which there is located a layer of friction material 22 and a second face 24 to which the hinge 16 is secured.

Figure 2A:
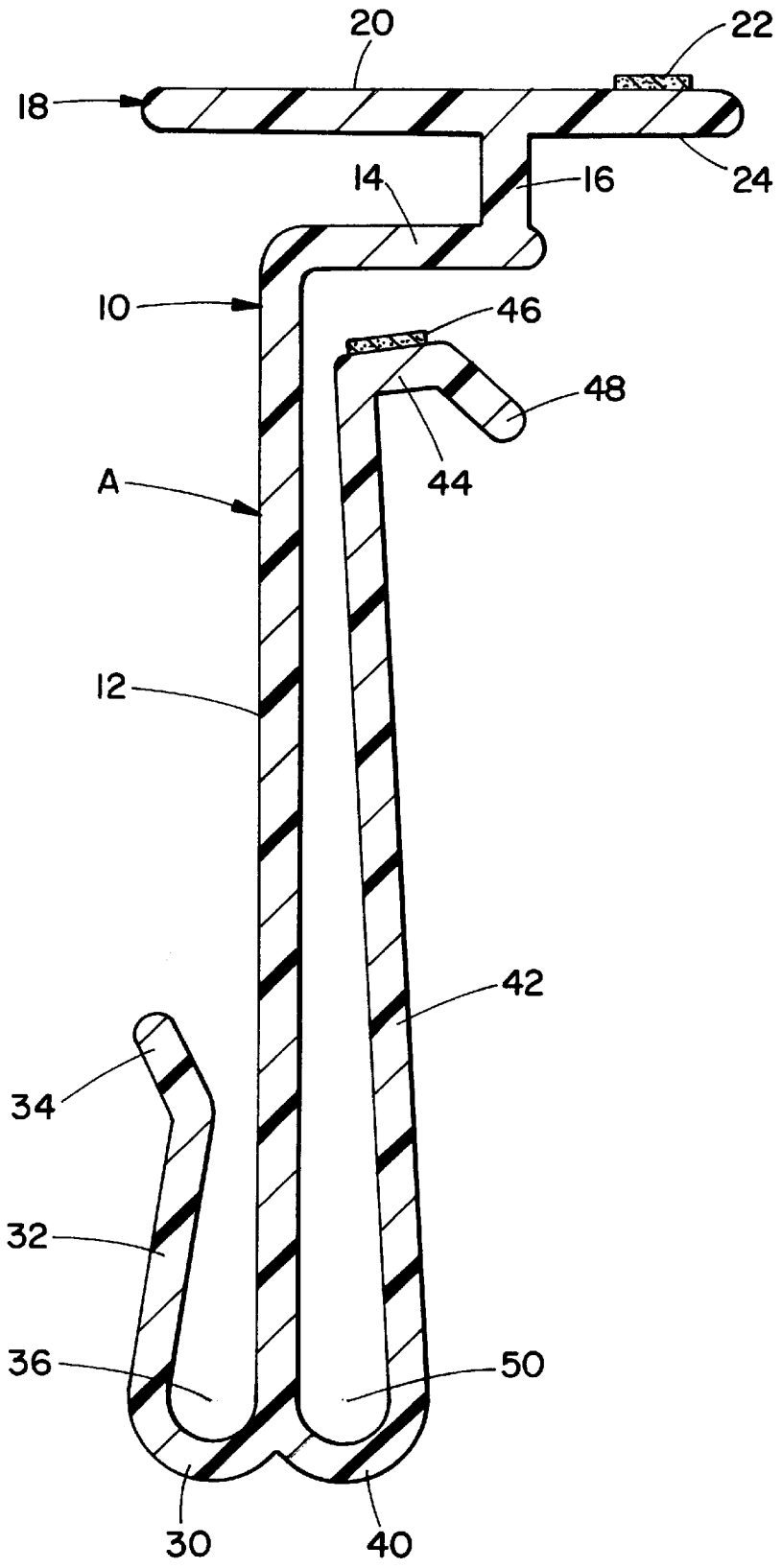
FIG. 2A is an enlarged side elevational view in cross-section of the hanger fixture of FIG. 1.

Located on a bottom end of the vertical wall 12 is a front bridge 30 which leads to a front retainer wall 32. The front wall extends approximately parallel to the vertical wall and terminates in an angled lip 34. With reference now to FIG. 2A, a slot 36 is defined between the front wall 32 and the vertical wall 12. Extending also from the bottom end of the vertical wall 12 is a rear bridge 40 which leads to a rear retainer wall 42. The rear wall extends approximately parallel to the vertical wall. It has a top extension 44 on one surface of which there is provided a layer 46 of a friction material. The top extension terminates in an angled lip 48. A slot 50 is defined between the rear wall 42 and the vertical wall 12.

While it is evident from FIG. 2A that the front wall 32 and the rear wall 42 are substantially parallel to the vertical wall 12, they are in each case angled slightly so that the upper ends thereof lie closer to the vertical wall 12 than do the lower ends thereof. Thus the slots 36 and 50 are somewhat tapered in the uninstalled condition of the hanger fixture A. It is also evident that the rear wall top end 44 is approximately parallel to but spaced from the top wall 14 of the hanger body.

Preferably the hanger fixture A is made from a suitable conventional resilient material such as a thermoplastic. The layers of friction material 22 and 46 and the hinge 16 can be made from one type of thermoplastic material whereas the remainder of the hanger fixture A can be made from a different type of thermoplastic material. Preferably, the thermoplastic materials are different types of polyvinylchloride (PVC). In the preferred embodiment, the hanger fixture A can be integrally produced by being extruded by a known co-extrusion process from the different thermoplastic materials. The fixture A can be transparent as is illustrated in FIG. 1. Since the hinge 16 is made from a suitable resilient material, it has a memory and will maintain its unstressed condition illustrated in FIG. 1 before the hanger fixture A is assembled to the shelf B. The hinge 16 will return to its unstressed condition when the hanger fixture is disassembled from the shelf B.

Figure 2D:
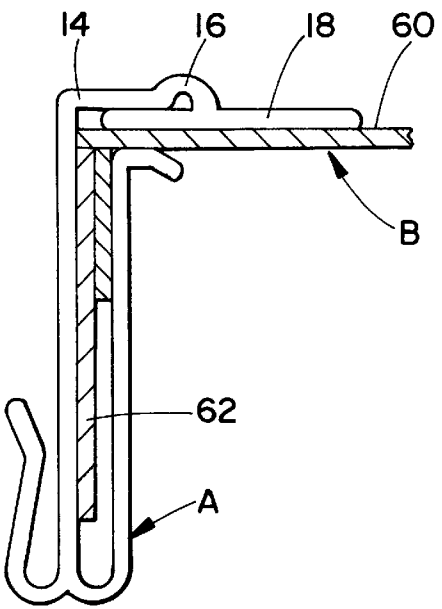
FIGS. 2B–2D are side elevational views of the hanger fixture of FIG. 2A in the process of being installed on the store shelf of FIG. 1.
Figure 2C:
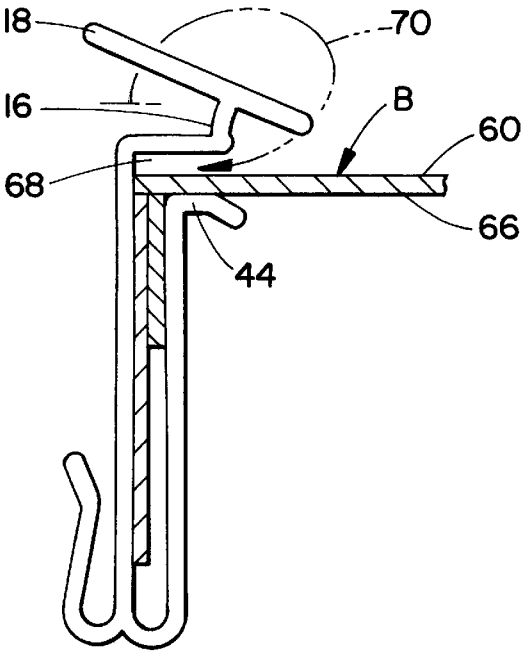
Figure 2B:
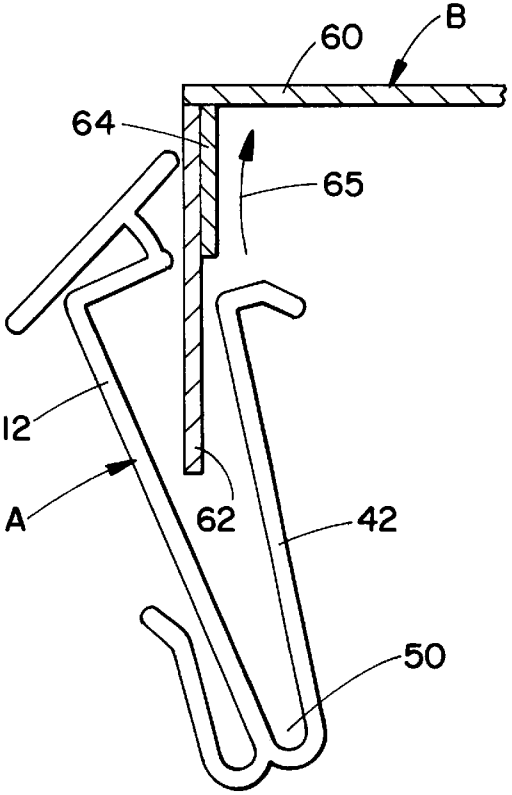

With reference now to FIGS. 2B–2D, the process of installing the hanger fixture A on the store shelf B is there illustrated. FIG. 2B shows that the store shelf includes a top wall 60 and a side wall 62. The side wall is shown to have a reinforced upper section 64. In order to secure the hanger fixture A to the store shelf B, the rear wall 42 thereof is pushed away from the vertical wall 12. This allows the hanger fixture A to be moved upwardly, in the direction of arrow 65 enabling the side wall 62 of the store shelf B to protrude into the slot 48 between the vertical wall 12 and the rear wall 42.

Once the top wall 14 of the hanger fixture A clears the top wall 60 of the store shelf B, the hanger fixture can be rotated clockwise so that the hanger fixture top wall overlies the store top wall as is illustrated in FIG. 2C. The hanger fixture is then moved upwardly until the rear wall top extension 44 contacts a bottom side 66 of the store shelf top wall 60. When this is accomplished, there is created a gap 68 between the hanger body top wall and the store shelf top wall. At this time, the wing 18 of the hanger fixture can be rotated clockwise around the hinge 16 in relation to the top wall 14 of the hanger fixture as is illustrated by the dashed arrow 70.

Due to the resilient nature of the thermoplastic material from which the hinge 16 is made, the wing 18 can be rotated 180° around the top wall 14 so that the wing lies beneath the top wall as is illustrated in FIG. 2D. The wing 18 and the rear wall 42 are suitably sized in thickness so that the wing 18 can underlie the top wall 14 and serve as a locking means for locking the hanger fixture A to the store shelf B as is illustrated in FIG. 2D.

The friction surfaces 22 and 46 prevent a sliding movement of the hanger fixture A along the shelf B. In other words, the hanger fixture A is not able to be easily slid in relation to the shelf side wall 62. For this purpose, the two friction surfaces 22 and 46 face each other on opposed sides of the shelf top wall 60 in FIG. 2D. The spacing between the wing 18 and the top extension 44, when the wing is folded over as shown in FIG. 2D, is sized to accommodate the thickness of the shelf top wall 60. With different thicknesses of the shelf top wall, different spacings will be necessary between the wing 18 and the top extension 44.

Figure 3:
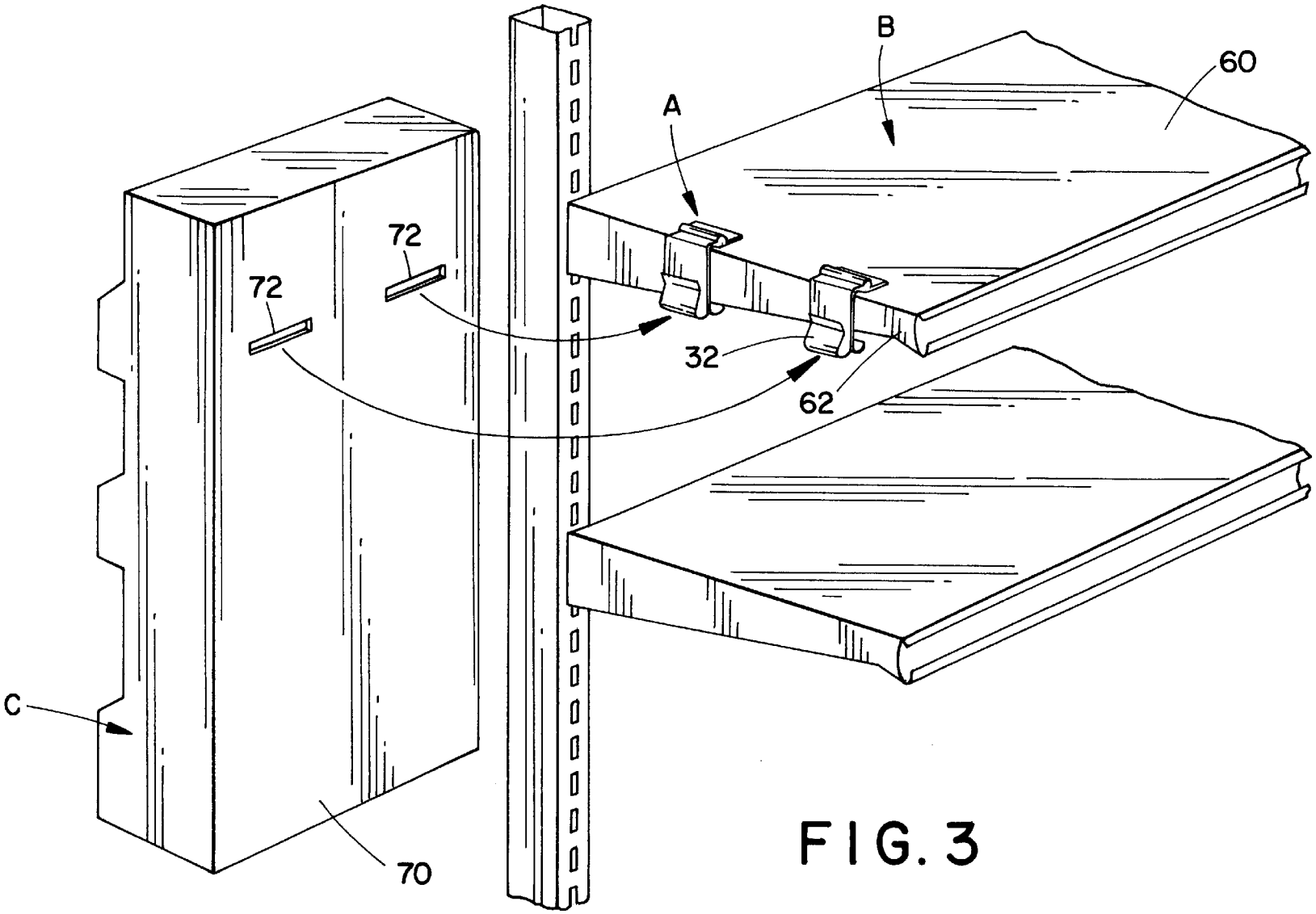
FIG. 3 is a perspective view on a reduced scale of a pair of hanger fixtures after they are secured on a store shelf and in the process of having a display rack mounted thereon.

With reference now to FIG. 3, the store shelf B is shown as having a pair of hanger fixtures A secured thereto in a spaced manner from each other. Now a suitable conventional display rack C can be mounted on the hanger fixtures. To this end, a rear face 80 of the display rack C has located therein a pair of horizontally-extending spaced slots 72. The hanger fixtures A are so spaced along the side wall 62 of the store shelf B that the slots 72 can allow the front walls 32 of the hanger fixtures A to protrude within the display rack C. The display rack is lowered on the hanger fixtures A until the edge of the back wall 70 overlying the slots 72 contact the bridges 30 of the pair of hanger fixtures. Gravity then holds the display rack C on the hanger fixtures A. In this way, the display rack is mounted on the store shelf B quickly and inexpensively. However, the display rack C is mounted in a sturdy manner to minimize the possibility that the display rack itself will swing or move laterally relative to the store shelf B.

Removal of the hanger fixtures A is facilitated by the design of the present invention. That is, the wing 18 can be pivoted counterclockwise around the hinge 16 so as to allow the wing to take its initial position as illustrated in FIG. 2A. The hanger fixture retains this position due to the memory of the resilient thermoplastic material from which the hanger fixture A is manufactured. Once this is accomplished, the hanger can be disconnected from the store shelf in a ready manner. With only the front wall 32 extending into the display rack C through the slots 72, it can be seen that the display rack can be lifted with minimal effort from the hanger fixtures and hence, the shelf.

With the hanger fixture A according to the present invention, no adhesive is necessary to fasten the hanger body 10 to a store shelf. This is advantageous from the standpoint that no layer of adhesive will be left on the store shelf nor will there be any damage caused to the store shelf by the removal of the hanger fixture therefrom. As can be seen from FIG. 3, the hanger fixture A according to the present invention will accommodate varying lengths of store shelf side walls 62 while still providing a locking engagement between the hanger fixture and the store shelf B when so desired.

Figure 4:
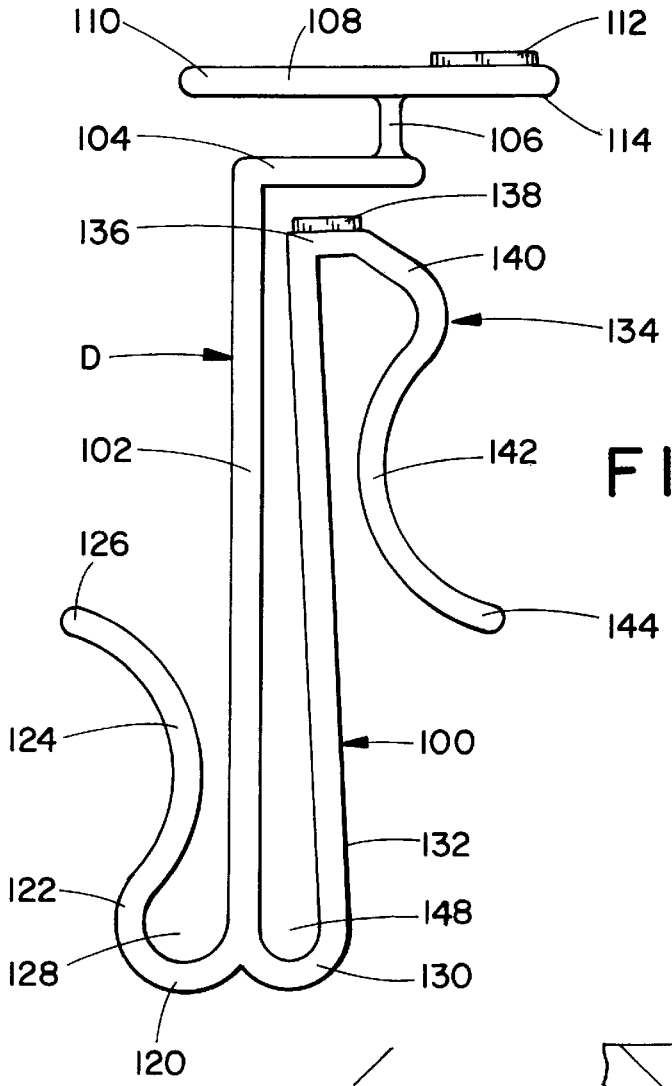
FIG. 4 is a side elevational view of a hanger fixture according to a second preferred embodiment of the present invention.
Figure 5:
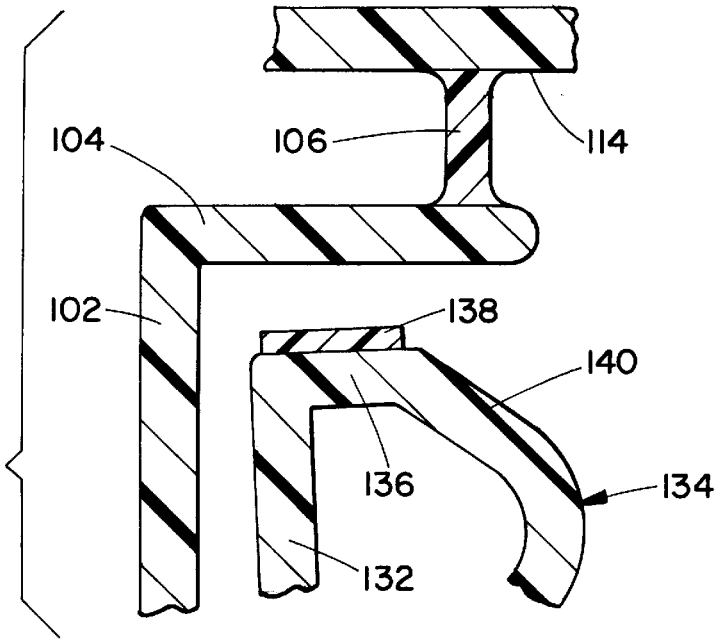
FIG. 5 is an enlarged cross-sectional view of a portion of the hanger fixture of FIG. 4.

With reference now to FIG. 4, a second preferred embodiment of the present invention will be there illustrated. FIG. 4 illustrates a hanger fixture D. The hanger fixture comprises a hanger body 100 having a vertical wall 102 and extending at approximately a right angle therefrom, a horizontal or top wall 104. Disposed adjacent a free end of the top wall is a hinge 106 made from a resilient material. The hinge connects the top wall to a wing 108 which extends parallel to the top wall when the hinge is not in use. The wing has a first face 110 on which there is located a layer of friction material 112 and a second face 114 to which the hinge 106 is secured.

Located on the vertical wall 102 is a retainer means. In this embodiment, the retainer means comprises a front bridge 120 which leads to a front retainer wall 122. The front retainer wall includes an inwardly curved section 124 and an outwardly curved protruding lip 126. A slot 128 is defined between the front wall 122 and the vertical wall 102. Extending also from the bottom end of the vertical wall 102 is a rear bridge 130 which leads to a rear retainer wall 132. The rear retainer wall extends approximately parallel to the vertical wall 102. Provided on the rear retainer wall 132 is a top extension 134. The top extension includes a first section 136 which is oriented approximately parallel to the top wall 104. Located on the surface of the first section 136 facing the top wall 104 is a layer of friction material 138. The top extension 134 also includes a second section 140 which angles away from the top wall 104, and an inwardly curved third section 142. The top extension terminates in an outwardly curved fourth section 144. A slot 148 is defined between the rear wall 132 and the vertical wall 12.

While it is evident from FIG. 4 that the front wall 122 and rear wall 132 extend somewhat parallel to the vertical wall 102, they include in each case an angled section which extends back towards the vertical wall 102. Thus the slots 128 and 148 are each tapered somewhat in the uninstalled condition of the hanger fixture D.

Figure 8:
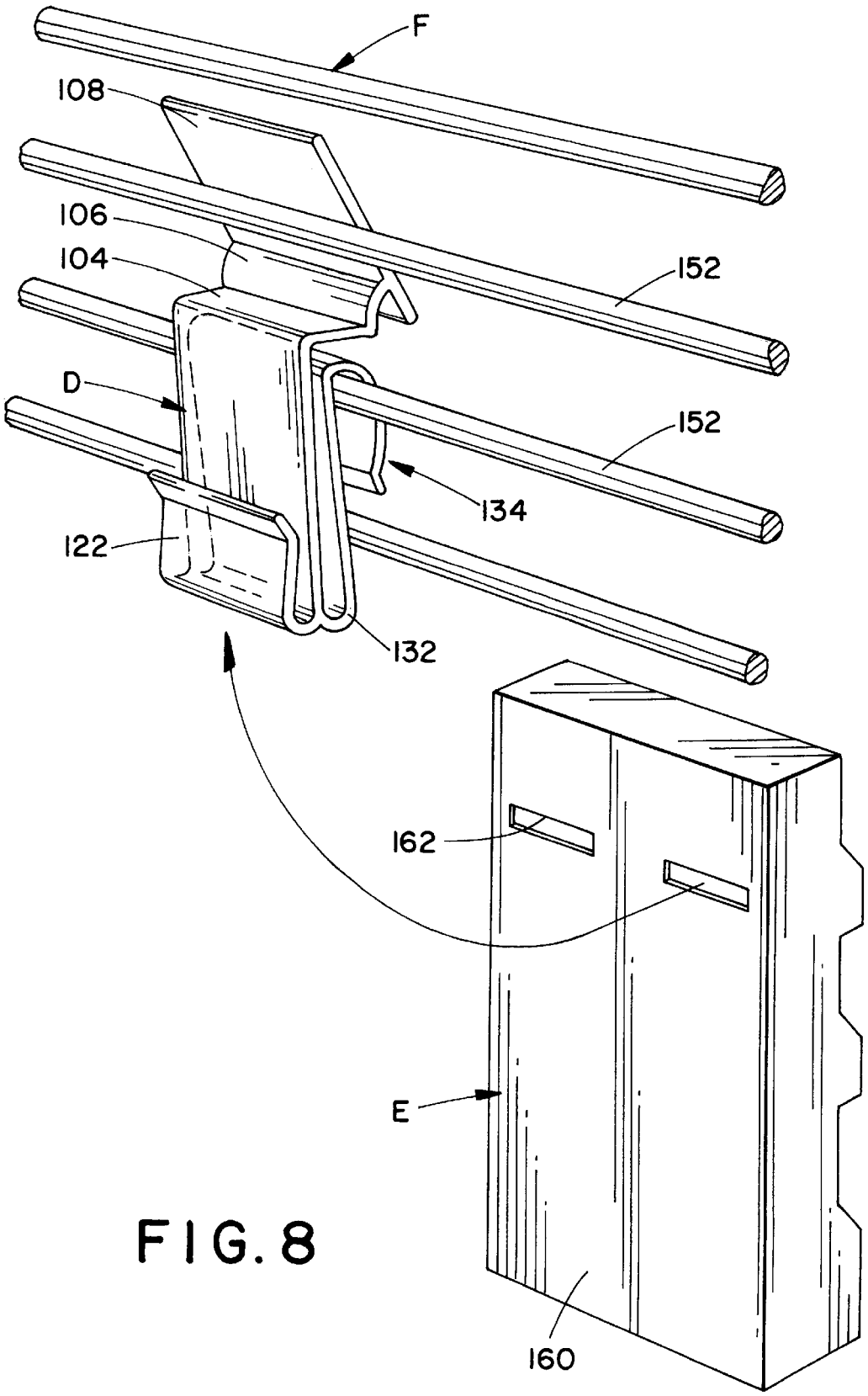
FIG. 8 is a perspective view illustrating another way of using a pair of the hanger fixtures of FIG. 4 to suspend a display rack from a set of wire rods.

As with the hanger fixture A of FIG. 1, preferably the hanger fixture D is made from a suitable conventional resilient material such as a coextruded PVC thermoplastic material. The hinge 106, friction material 112 and friction material 138 can be made from a first type of softer PVC whereas the wing 108 and the remainder of the hanger fixture can be made from a harder PVC material. The hanger fixture D can be transparent as is illustrated in FIG. 8.

Figure 6:
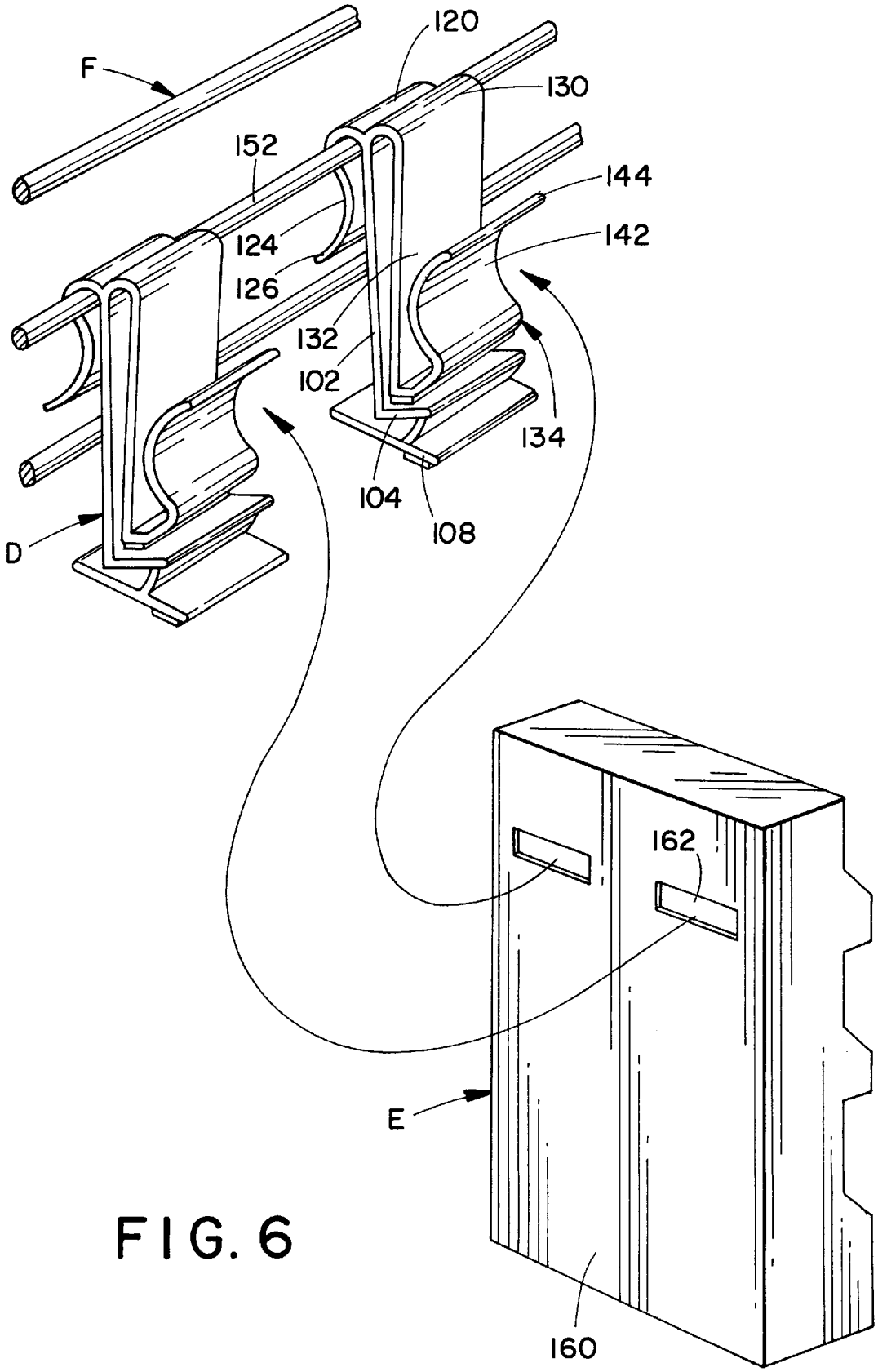
FIG. 6 is a perspective view illustrating one way of using a pair of the hanger fixtures of FIG. 4 to suspend a display rack from a set of wire rods.

With reference now to FIG. 6, the hanger assembly D can be employed in three different ways. The first way of using the hanger assembly D is identical to what is disclosed in FIGS. 2B–2D and 3. In other words, the hanger assembly D can be employed to suspend a display rack from a store shelf. However, the hanger assembly D can also be employed to suspend a display rack E from a wire shelving assembly F when the hanger assembly is employed in an upside down position as shown in FIG. 6 or in a right side up position as shown in FIG. 8.

In the position illustrated in FIG. 6, the hanger assembly D is suspended via the front bridge 120 from a wire rod 152 in a manner upside down from the use of the hanger assembly D when secured on a shelf. The ire rod 152 is one of a series of spaced parallel rods comprising the wire shelving assembly F. It is evident from FIG. 6 that the front wall 122 of the hanger assembly D snaps onto the wire rod 152 such that the inwardly curved section 124 is flexed away from the vertical wall 102 as the hanger assembly descends on the wire rod until the wire rod is nestled beneath the front bridge 120. The top extension 134 is employed to secure the display rack E in place on the wire shelving assembly F. To this end, a rear face 160 of the display rack E includes a pair of spaced slots 162.

Figure 7:
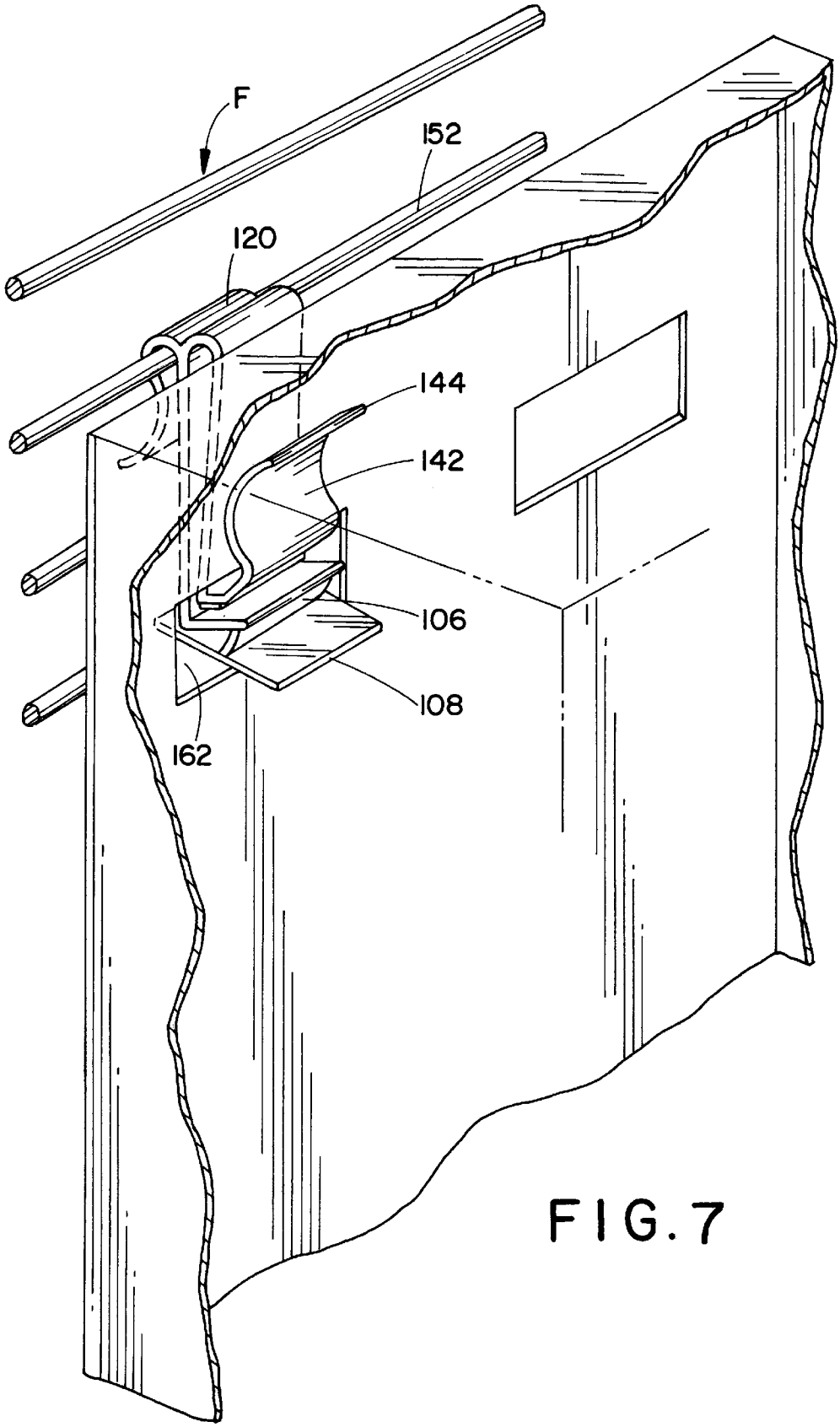
FIG. 7 is a perspective view illustrating the display rack of FIG. 6 being suspended from the hanger fixture of FIG. 4.

As illustrated in FIG. 7, the fourth section 144 or protruding lip of the top extension 134, can be maneuvered into the slot 162 as can the third section 142. The third section, or inwardly curved section 142, is moved away from the rear retainer wall 132 for this purpose by the rear wall 160 of the display rack E. This is to assure that the clip holds the display rack in place and does not allow it to move. The slot 162 is of sufficient size so as to accommodate not only the top extension 134, but also the top wall 104 and the wing 108 as is evident from FIG. 7. In use, the hanger assemblies D are clipped into the slots 162 on the display rack. Only subsequently are the hanger assemblies then positioned on the wire rod 152 of the wire shelving assembly F. It has been found easier to assemble the hanger assemblies D on the display rack E before securing same to the wire shelving assembly F than to secure the hanger assemblies on the wire shelving assembly and then secure the display rack on the hanger assemblies.

With reference now to FIG. 8, another way of using the hanger fixture D is there illustrated. Unlike the upside down configuration illustrated in FIG. 6, the hanger fixture D can also be used in a right side up configuration when suspended from a wire shelving assembly F. In this arrangement, the top extension 134 is employed to suspend the hanger fixture D from one of a plurality of spaced wire rods 152. With this arrangement, the wing 108 is positioned above an adjacent wire rod 152. It should be appreciated that the wing is angled away from a parallel relation to the top wall 104 via the hinge 106. The display rack E is, in the embodiment illustrated in FIG. 8, suspended from the front retainer wall 122. The front retainer wall 122 protrudes into the slot 162 located on the rear wall 160 of the display rack E. It should be appreciated that the front retainer wall 122 is illustrated as being similar to the front retainer wall 32 in FIG. 1, although it could instead have the front retainer wall configuration illustrated in FIG. 4.

Figure 9:
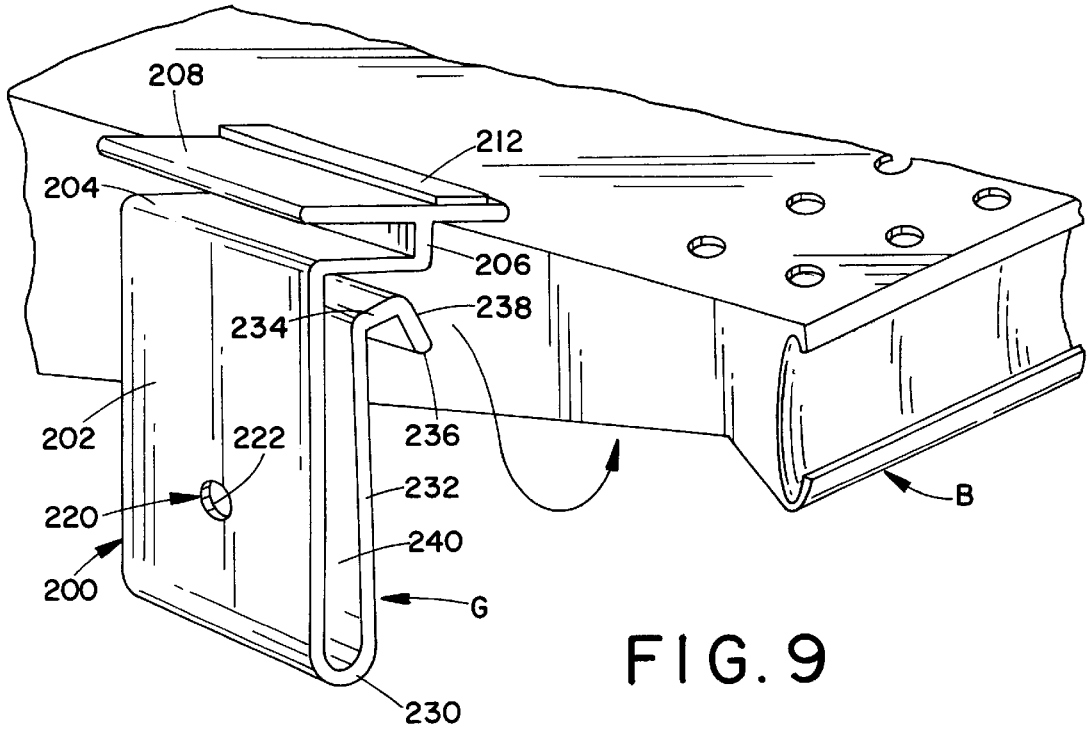
FIG. 9 is an exploded perspective view illustrating a hanger fixture according to a third preferred embodiment of the present invention.

With reference now to FIG. 9, a third preferred embodiment of the present invention includes a hanger fixture G which can be employed with the store shelf B illustrated in FIG. 1. The hanger fixture comprises a hanger body 200 having a front vertical wall 202 and extending at an approximately right angle therefrom, and a front horizontal wall 204. Disposed adjacent a free end of the horizontal wall 204 is a hinge 206 made from a resilient material. The hinge connects the front horizontal wall to a wing 208 which extends parallel to the front horizontal wall when the hinge is not in use. A layer of friction material 212 is provided on one face of the hinge. Located on the front vertical wall 202 is a retainer means 220. In this embodiment, the retainer means comprises an aperture 222 which extends through the front vertical wall 202. A suitable conventional retainer clip (not illustrated) can selectively extend through the aperture 222 and through an aligned similar aperture in a conventional display rack, such as the display rack C illustrated in FIG. 3 or the display rack E illustrated in FIG. 6 in order to selectively fasten the display rack to the hanger body.

A bridge 230 extends rearwardly from the front vertical wall and connects it to a rear vertical wall 232. The rear vertical wall extends approximately parallel to the front vertical wall 202. Connected to the rear vertical wall is a rear horizontal wall which terminates in a lip 236. A layer of friction material 238 is located on the rear horizontal wall 234. The front and rear vertical walls 202 and 232 and the front and rear horizontal walls 204 and 234 define between them a somewhat reverse upside down L-shaped slot 240. As in the embodiment of FIGS. 1–3, the hanger body 200 can be selectively secured to a store shelf B.

Figure 10:
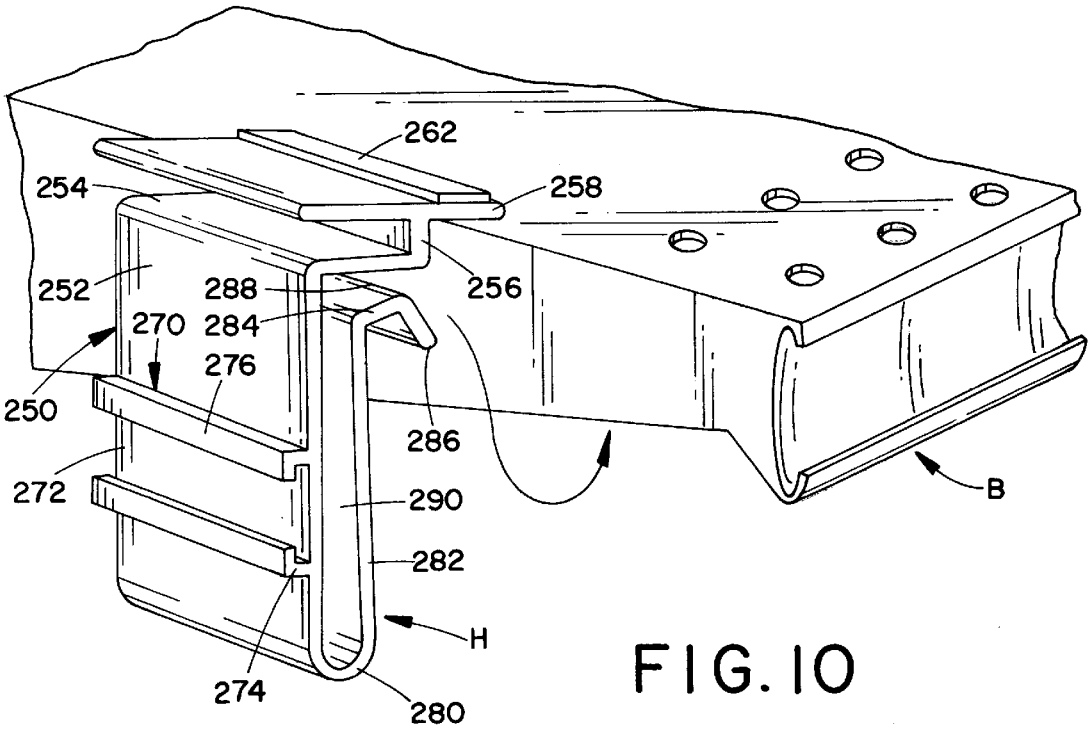
FIG. 10 is a perspective view of a hanger fixture according to a fourth preferred embodiment of the present invention.

With reference now to FIG. 10, a fourth preferred embodiment of the present invention includes a hanger assembly H comprising a hanger body 250 having a front vertical wall 252 and a front horizontal wall 254. Extending from the horizontal wall is a hinge 256 which is connected to a wing 258. A layer of friction material 262 is disposed on one face of the wing. Positioned on the front vertical wall is a retainer means 270. In this embodiment, the retainer means comprises a channel 272 which is defined by a lower lip 274 and an upper lip 276 which are spaced from each other and extend from and are oriented normal to the front vertical wall. The channel can be employed with a conventional C channel adaptor (not illustrated) so as to enable a desired type of display rack or container to be secured thereto.

As in the previous embodiments, the hanger assembly H further comprises a bridge 280 which connects to a rear vertical wall that extends substantially parallel to the front vertical wall. The rear vertical wall is connected to a rear horizontal wall that has at least a section substantially parallel to the front horizontal wall. The rear horizontal wall terminates in a lip 286. A layer of friction material 288 is located on the rear horizontal wall. The front and rear vertical walls 252 and 282 and the front and rear horizontal walls 254 and 284 define between them a slot 290 to accommodate a side wall of the shelf B.

Figure 11:
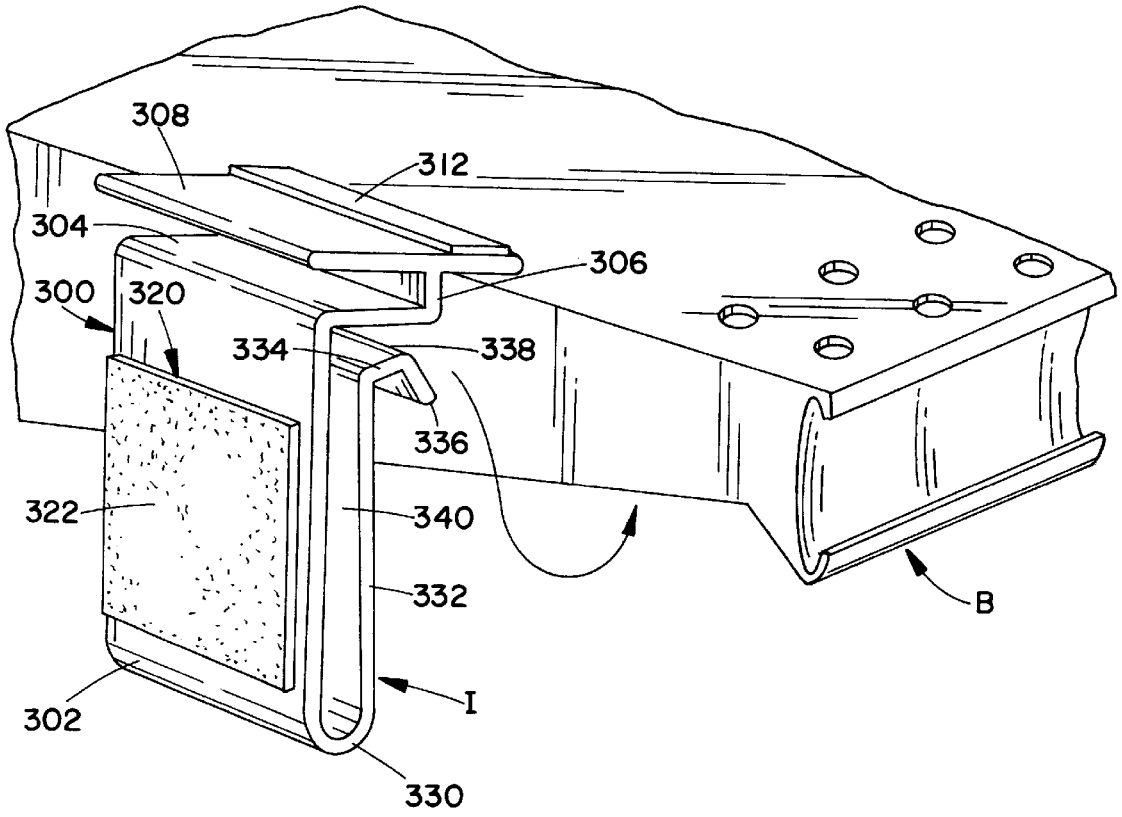
FIG. 11 is a perspective view of a hanger fixture according to a fifth preferred embodiment of the resent invention.

With reference now to FIG. 11, this figure illustrates a fifth preferred embodiment of the present invention. In this embodiment, a hanger body 300 includes a front vertical wall 302 and a front horizontal wall 304 to which is connected a hinge 306. The hinge is also connected to a wing 308 which includes on one surface a layer of friction material 312. In this embodiment, the front vertical wall 302 is provided with a retainer means 320 in the form of an adhesive layer 322. The adhesive layer can be employed with a suitable conventional type of display rack or container to secure the rack or container to the hanger body 300. The rack or container would most likely be permanently secured to the hanger body 300, although it could be selectively detached therefrom if so desired. As in the earlier embodiments, the hanger body can itself can be selectively secured to or detached from a suitable conventional store shelf B.

As in the earlier embodiments, the hanger body 300 also includes a bridge 330 leading to a rear vertical wall 332 and a rear horizontal wall 334 which terminates in a lip 336. A layer of friction material 338 is located on the rear horizontal wall 334 so that it can cooperate with a wall of the store shelf B as well as with the wing 308. A slot 340 is defined between the front and rear vertical walls and the front and rear horizontal walls so as to accommodate both a side wall and a top wall of the store shelf B.

Figure 12:
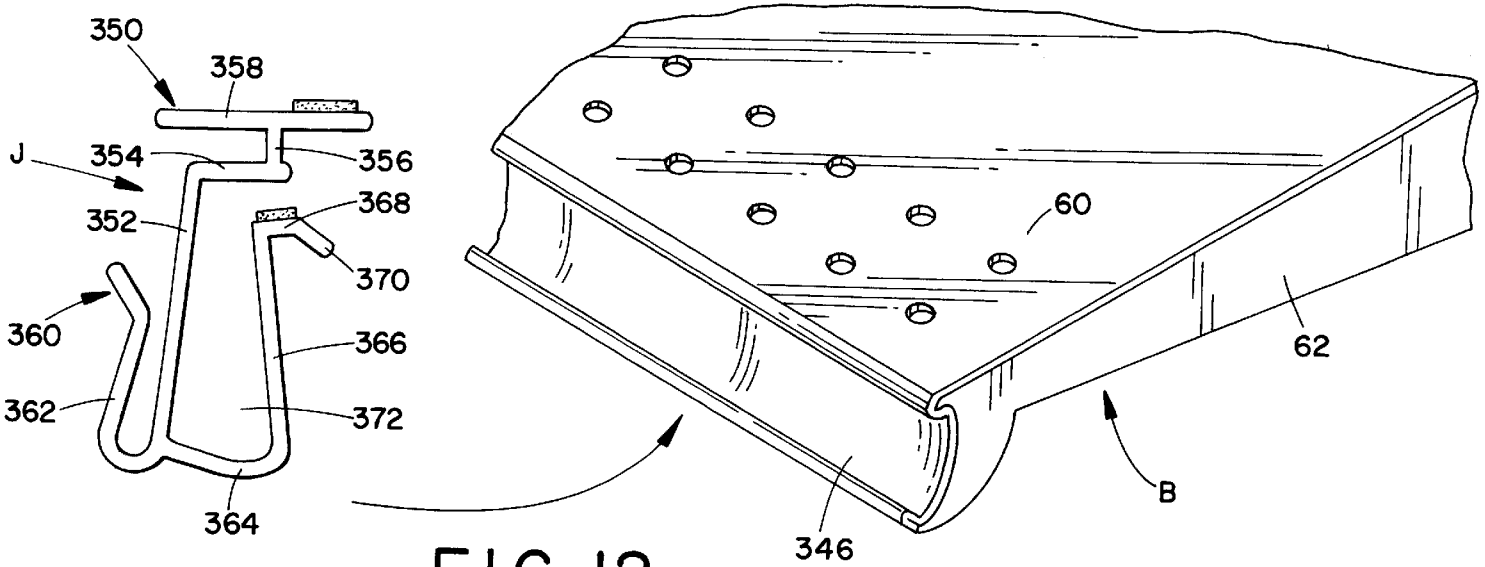
FIG. 12 is an exploded view, with a first portion in side elevation and a second portion in perspective, of a hanger fixture according to a sixth preferred embodiment of the present invention; and, FIG. 13 is a side elevational view of the hanger fixture of FIG. 12 in the process of being secured to the shelf of FIG. 12.
Figure 13:
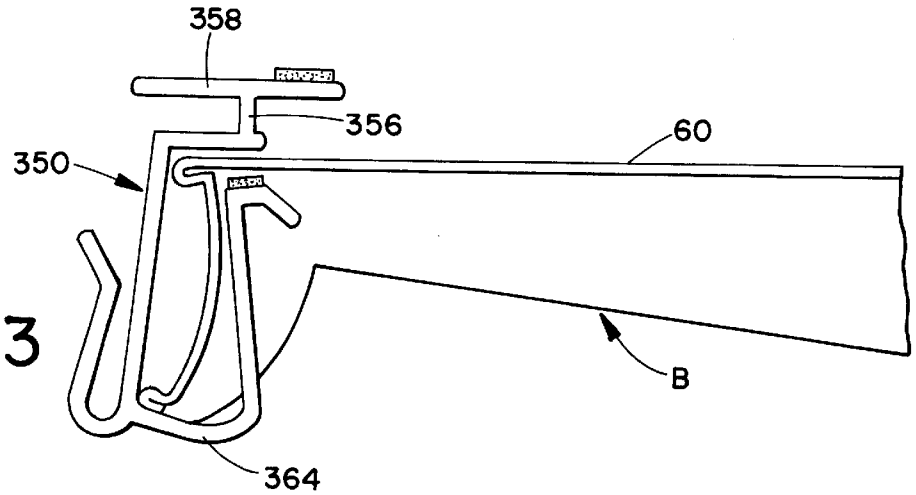

With reference now to FIG. 12, a hanger assembly J according to a sixth preferred embodiment of the present invention is there illustrated. While in the earlier embodiments, the hanger assemblies were all meant to be secured to the side wall 62 of the store shelf B, in this embodiment the hanger assembly J can be secured over a C-channel 346 provided on a front wall of the store shelf B. In this embodiment, the hanger assembly J comprises a hanger body 350 having a front vertical wall 352, a front horizontal wall 354, a hinge 356 and a wing 358. In this embodiment, a retainer means 360 comprises a retainer wall 362 secured to the front vertical wall 350. Extending from a lower edge of the front vertical wall 352 is a rear connector wall 364. The rear connector wall is of suitable size so as to accommodate the curved C-channel 346 of the shelf B as best illustrated in FIG. 13. Extending from the rear connector wall is a rear vertical wall 366 and a rear horizontal wall 368 which terminates in a lip 370. A slot 372 which is defined between the front vertical wall 352 and the rear vertical wall 366 accommodates the C-channel 346.

It is evident from FIGS. 12 and 13 that in this embodiment the front vertical wall 352 is forwardly angled whereas the rear vertical wall 366 is somewhat rearwardly angled so as to provide a somewhat tapered slot 372. In other words, the slot has a larger lower end and a smaller upper end. This accommodates the outwardly curving lower end of the C-channel 346 as best seen in FIG. 13. As in the other embodiments, the wing 358 can be pivoted around the hinge 356 to bring it into contact with the top surface 60 of the shelf B and thereby secure the hanger body 350 in place on the shelf B. It should also be appreciated that while a retainer means 360 in the form of a retainer wall 362 is illustrated in FIGS. 12 and 13, it is entirely conceivable to replace the retainer wall 362 with the types of retainer means illustrated in FIGS. 8, 9 or 10 as well as with other types of retainer means known to the art.

The invention has been described with reference to several preferred embodiments. Obviously, modifications and alterations will occur to others upon reading and understanding this specification. It is intended to include all such modifications and alterations insofar as they come within the scope of the appended claims or the equivalents thereof.

We claim:

1. An integrally formed hanger fixture, comprising:

a first wall;

a second wall connected to said first wall and angling away therefrom;

a retainer element located on said first wall;

a wing overlying said second wall; and, a hinge connecting said wing to said second wall, wherein said hinge enables said wing to pivot in relation to said second wall until said wing is disposed beneath said second wall.

2. The hanger fixture of claim 1 further comprising a layer of a friction material located on one face of said wing.

3. The hanger fixture of claim 1 further comprising a third wall connected to said first wall and extending in a spaced substantially parallel manner in relation thereto.

4. The hanger fixture of claim 3 wherein said third wall comprises a top extension which is located below said second wall.

5. The hanger fixture of claim 4 further comprising a layer of a friction material located on at least part of one face of said top extension.

6. The hanger fixture of claim 1 wherein said retainer element comprises a retaining wall secured to said first wall.

7. The hanger fixture of claim 1 wherein the retainer element comprises an aperture extending through said first wall.

8. The hanger fixture of claim 1 wherein the retainer element comprises a channel secured to said first wall.

9. The hanger fixture of claim 1 wherein said retainer element comprises a layer of adhesive secured to said first wall.

10. An integrally formed hanger fixture comprising:

a first wall;

a second wall connected to said first wall and angling away therefrom;

a retainer element located on said first wall; and, a pivotable locking member connected to said second wall and overlying at least a portion of said second wall in a first position thereof, wherein said pivotable locking member is located beneath at least a portion of said second wall in a second position thereof.

11. The hanger fixture of claim 10 wherein said first wall comprises a front substantially vertically oriented wall having a first end and a second end and wherein said second wall comprises a front substantially horizontally oriented wall.

12. The hanger fixture of claim 11 further comprising:

a rear substantially vertically oriented wall extending in a spaced approximately parallel manner to said front substantially vertically oriented wall and having a first end and a second end; and, a bridge connecting said front substantially vertically oriented wall to said rear substantially vertically oriented wall.

13. The hanger fixture of claim 12 further comprising:

a rear substantially horizontally oriented wall connected to said rear substantially vertically oriented wall adjacent said first end and extending away therefrom, said rear substantially horizontally oriented wall being spaced from said front substantially horizontally oriented wall.

14. The hanger fixture of claim 13 wherein said pivotable locking member comprises:

a wing spaced from said front substantially horizontally oriented wall; and, a hinge connecting said wing to said front substantially horizontally oriented wall, wherein said hinge enables said wing to pivot in relation to said front substantially horizontally oriented wall.

15. The hanger fixture of claim 10 wherein said retainer element comprises a retaining wall secured to said first wall.

16. The hanger fixture of claim 10 wherein said retainer element comprises an aperture extending through said first wall.

17. The hanger fixture of claim 10 wherein said retainer element comprises a channel secured to said first wall.

18. The hanger fixture of claim 10 wherein said retainer element comprises a layer of adhesive secured to said first wall.

19. The hanger fixture of claim 10 wherein said pivotable locking member comprises:

a wing spaced from said second wall; and, a hinge connecting said wing to said second wall, wherein said hinge enables said wing to pivot in relation to said second wall.

20. The hanger fixture of claim 14 wherein said rear substantially horizontally oriented wall comprises a layer of a friction material located on at least a part of one face of said wall.

21. The hanger fixture of claim 20 further comprising a layer of a friction material located on at least a part of one face of said wing.

22. The hanger fixture of claim 21 wherein said layer of friction material on said wing and said layer of friction material on said rear substantially horizontally oriented wall face each other when said wing is pivoted so that it underlies said front substantially horizontally oriented wall.

23. A hanger fixture for supporting a display rack, said hanger fixture comprising:

a front substantially vertically oriented wall having a first end and a second end;

a front substantially horizontally oriented wall connected to said front substantially vertically oriented wall adjacent said first end thereof;

a retainer means located on said front substantially vertically oriented wall for selectively retaining an associated display rack;

a wing spaced from said front substantially horizontally oriented wall; and, a hinge connecting said wing to said front substantially horizontally oriented wall, wherein said hinge enables said wing to pivot in relation to said front substantially horizontally oriented wall.

24. The hanger fixture according to claim 23 further comprising:

a rear substantially vertically oriented wall connected to said front substantially vertically oriented wall adjacent said second end thereof and extending in a spaced approximately parallel manner in relation thereto.

25. The hanger fixture of claim 24 further comprising a rear substantially horizontally oriented wall extending from said rear substantially vertically oriented wall, wherein said rear substantially horizontally oriented wall is spaced from said front substantially horizontally oriented wall.

26. The hanger fixture of claim 25 further comprising:

a layer of a friction material located on at least a part of one face of said wing; and a layer of a friction material located on at least part of one face of said rear substantially horizontally oriented wall, wherein said layer of friction material on said wing and said layer of friction material on said rear substantially horizontally oriented wall face each other when said wing is pivoted so that it underlies said front substantially horizontally oriented wall.

27. The hanger fixture of claim 24 wherein the hanger fixture is of one piece and is formed from a resilient material that enables said hinge to pivot said wing in relation to said front substantially horizontally oriented wall and also enables said rear substantially vertically oriented wall to move in relation to said front substantially vertically oriented wall.

28. The hanger fixture of claim 24 wherein said retainer means comprises a retaining wall extending from said front substantially vertically oriented wall adjacent said second end thereof.

* * * * *